US009732613B2

(12) United States Patent
Duhme et al.

(10) Patent No.: US 9,732,613 B2
(45) Date of Patent: Aug. 15, 2017

(54) ROLLER CUTTER ARRANGEMENT AND CUTTING WHEEL EQUIPPED WITH SAID ROLLER CUTTER ARRANGEMENT

(71) Applicant: HERRENKNECHT AKTIENGESELLSCHAFT, Schwanau (DE)

(72) Inventors: Ruben Duhme, Singapore (SG); Thomas Edelmann, Bühl (DE); Zheng Gang Wang, Singapore (SG)

(73) Assignee: HERRENKNECHT AKTIENGESELLSCHAFT, Schwanau (DE)

( * ) Notice: Subject to any disclaimer, the term of this patent is extended or adjusted under 35 U.S.C. 154(b) by 0 days.

(21) Appl. No.: 15/308,258

(22) PCT Filed: Jun. 15, 2015

(86) PCT No.: PCT/EP2015/063275
§ 371 (c)(1),
(2) Date: Dec. 21, 2016

(87) PCT Pub. No.: WO2016/012156
PCT Pub. Date: Jan. 28, 2016

(65) Prior Publication Data

US 2017/0101868 A1 Apr. 13, 2017

(30) Foreign Application Priority Data

Jul. 22, 2014 (DE) ..... 10 2014 110 310

(51) Int. Cl.
*E21D 9/087* (2006.01)
*E21D 9/10* (2006.01)
*E21D 9/11* (2006.01)

(52) U.S. Cl.
CPC ..... *E21D 9/104* (2013.01); *E21D 9/112* (2013.01)

(58) Field of Classification Search
CPC ..... E21D 9/104; E21D 9/115; E21D 9/087
(Continued)

(56) References Cited

U.S. PATENT DOCUMENTS 3,851,718 A * 12/1974 Fink ..... E21D 9/104 175/363
4,479,401 A * 10/1984 Korkut ..... E02B 17/021 254/108

(Continued)

FOREIGN PATENT DOCUMENTS

DE 44 08 992 2/1995
DE 94 15 897 11/1995

(Continued)

OTHER PUBLICATIONS

International Preliminary Reporting on Patentability dated Jul. 7, 2016 in corresponding PCT Application No. PCT/EP2015/063275.

(Continued)

*Primary Examiner* — Sunil Singh
(74) *Attorney, Agent, or Firm* — Faegre Baker Daniels LLP

(57) ABSTRACT

A roller cutter arrangement for a cutting wheel of a tunnel boring machine, including an interchangeable cup, a bearing block which is supported in the interchangeable cup in such a way that it is displaceable along a displacement axis, and a cutting roller unit having at least one cutting roller, which is rotatably supported in the bearing block and which acts along a working axis. The working axis is angled with respect to the displacement axis, so that cutting rollers of the cutting roller units may be situated in close proximity to one another, in particular in the central area of the cutting wheel.

18 Claims, 7 Drawing Sheets

(58) Field of Classification Search
USPC ..... 405/138; 299/55, 58
See application file for complete search history.

(56) References Cited

U.S. PATENT DOCUMENTS

| | | | | |
|---|---|---|---|---|
| 8,523,288 | B2 * | 9/2013 | Hanaoka | E21D 9/112 299/56 |
| 9,222,356 | B2 * | 12/2015 | Hanaoka | E21D 9/087 |
| 9,222,357 | B2 * | 12/2015 | Yokoyama | E21D 9/087 |
| 2012/0274122 | A1 * | 11/2012 | Hanaoka | E21D 9/04 299/58 |

FOREIGN PATENT DOCUMENTS

| | | | |
|---|---|---|---|
| JP | 8-189296 | A * | 7/1996 |
| JP | 11-247594 | A * | 9/1999 |
| JP | 2013-72181 | A * | 4/2013 |
| JP | 2013-151784 | A * | 8/2013 |

OTHER PUBLICATIONS

International Search Report and Written Opinion dated Dec. 14, 2015 in PCT/EP2015/063275.

* cited by examiner

ROLLER CUTTER ARRANGEMENT AND CUTTING WHEEL EQUIPPED WITH SAID ROLLER CUTTER ARRANGEMENT

CROSS-REFERENCE TO RELATED APPLICATION

This application is a U.S. National Phase Patent Application based on International Application Serial No. PCT/EP2015/063275 filed on Jun. 15, 2015, the disclosure of which is hereby explicitly incorporated by reference herein.

BACKGROUND OF THE INVENTION

1. Field of the Invention

The invention relates to a roller cutter arrangement, and to a cutting wheel equipped with roller cutter arrangements.

2. Description of the Related Art

A roller cutter arrangement and a cutting wheel equipped with roller cutter arrangements are known from DE 94 15 897 U1. This previously known roller cutter arrangement for a cutting wheel of a tunnel boring machine has an interchangeable cup, and a bearing block which is supported in the interchangeable cup in such a way that it is displaceable along a displacement axis. In addition, a cutting roller unit is present, which has at least one cutting roller which is rotatably supported in the bearing block and which acts along a working axis that is tilted with respect to the displacement axis.

Another roller cutter arrangement and a cutting wheel equipped with roller cutter arrangements are known from DE 44 08 992 C1. This previously known roller cutter arrangement for a cutting wheel of a tunnel boring machine has an interchangeable cup, and a bearing block, which is supported in the interchangeable cup in such a way that it is displaceable along a displacement axis. In addition, a cutting roller unit is present, which has at least one cutting roller which is rotatably supported in the bearing block and which acts along a working axis. In the previously known roller cutter arrangement, the displacement axis and the working axis are aligned. In the previously known cutting wheel of a tunnel boring machine, roller cutter arrangements are spaced relatively far apart from one another in a radial direction.

SUMMARY OF THE INVENTION

The present invention provides a roller cutter arrangement which allows a closely spaced arrangement, in particular in the central area of a cutting wheel of a tunnel boring machine when a displacement unit which moves the roller cutter is relieved of load.

Moreover, the present invention provides a cutting wheel for a tunnel boring machine, in which roller cutter arrangements in the central area are situated in close proximity to one another.

As a result of the displacement axis and the working axis being oriented at an angle relative to one another, and the parallel walls absorbing forces, in the roller cutter arrangement according to the invention, when a displacement unit which moves the roller cutter is relieved of load, multiple roller cutter arrangements according to the invention may be situated in close proximity to one another, in particular in the central area of a cutting wheel, the interchangeable cups being situated pointing away from one another at an angle, thus providing space for additional equipment that is required, in particular for interchanging cutting rollers.

In one form thereof, the present invention provides a roller cutter arrangement for a cutting wheel of a tunnel boring machine, comprising an interchangeable cup, a bearing block, which is supported in the interchangeable cup in such a way that it is displaceable along a displacement axis, and a cutting roller unit having at least one cutting roller, which is rotatably supported in the bearing block and which acts along a working axis, wherein the working axis is angled with respect to the displacement axis, characterized in that the interchangeable cup has parallel walls oriented in parallel to the displacement axis, and at one end on the front side has an angled wall which is angled with respect to the displacement axis and oriented in parallel to the working axis.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
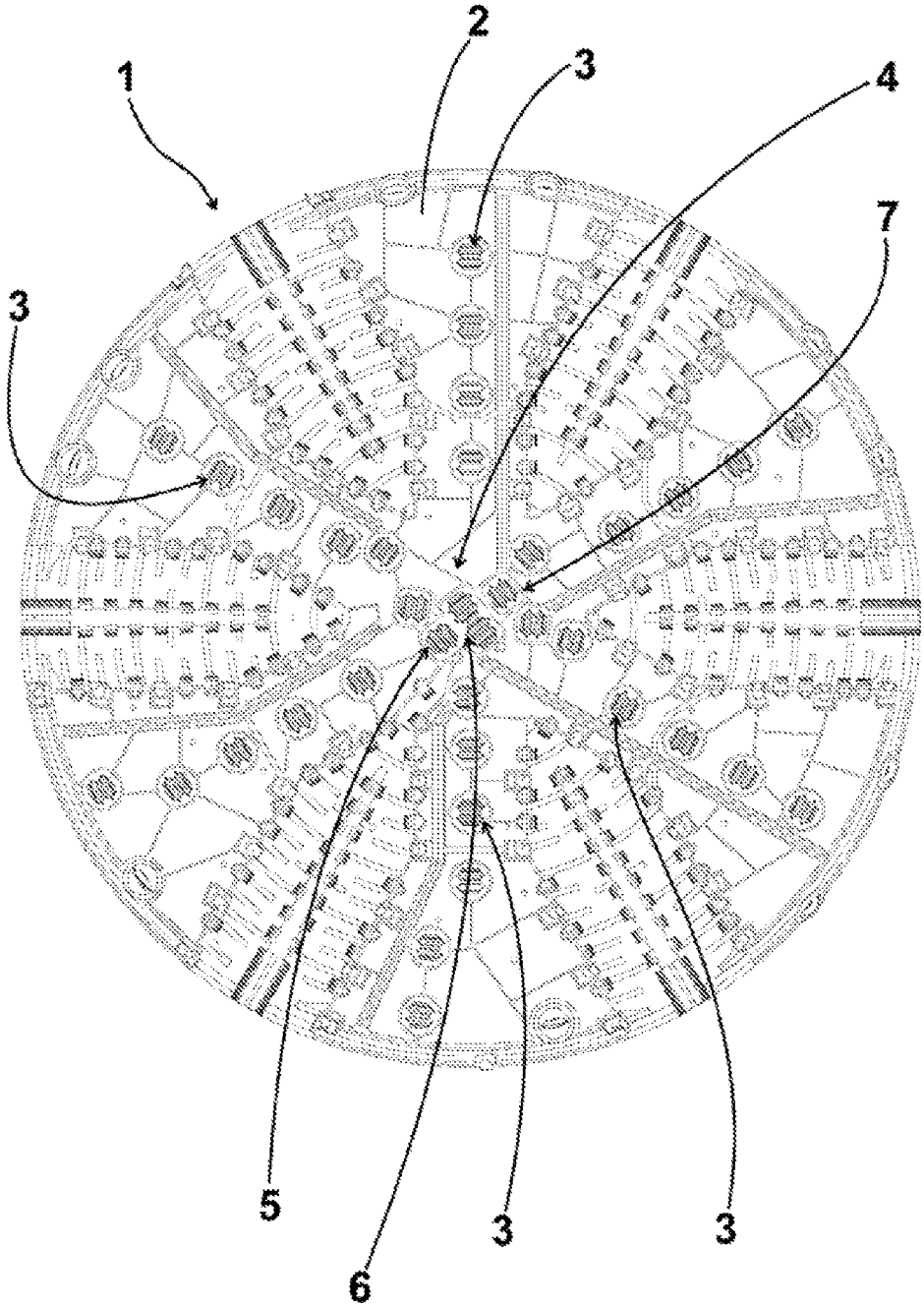
FIG. 1 shows an end-face view of one exemplary embodiment of a cutting wheel according to the invention of a tunnel boring machine, which in a central area is equipped with a number of exemplary embodiments of roller cutter arrangements according to the invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

FIG. 1 shows one exemplary embodiment of a cutting wheel 1 according to the invention of a tunnel boring machine in an end-face view of the front side, in the excavation direction. The cutting wheel 1 has a flat cutting wheel plate 2 which is fitted with a number of peripheral roller cutter arrangements 3, known per se. The peripheral roller cutter arrangements 3 are situated on the radially outer side of a centrally located central area 4 of the cutting wheel plate 2, and in each case are spaced relatively far apart from one another in a radial direction. In this embodiment, a singly fitted central cutting roller arrangement 5, a doubly fitted central cutting roller arrangement 6, and at least one transition cutting roller arrangement 7 are present in the central area 4 as exemplary embodiments of roller cutter arrangements according to the invention.

Figure 2:
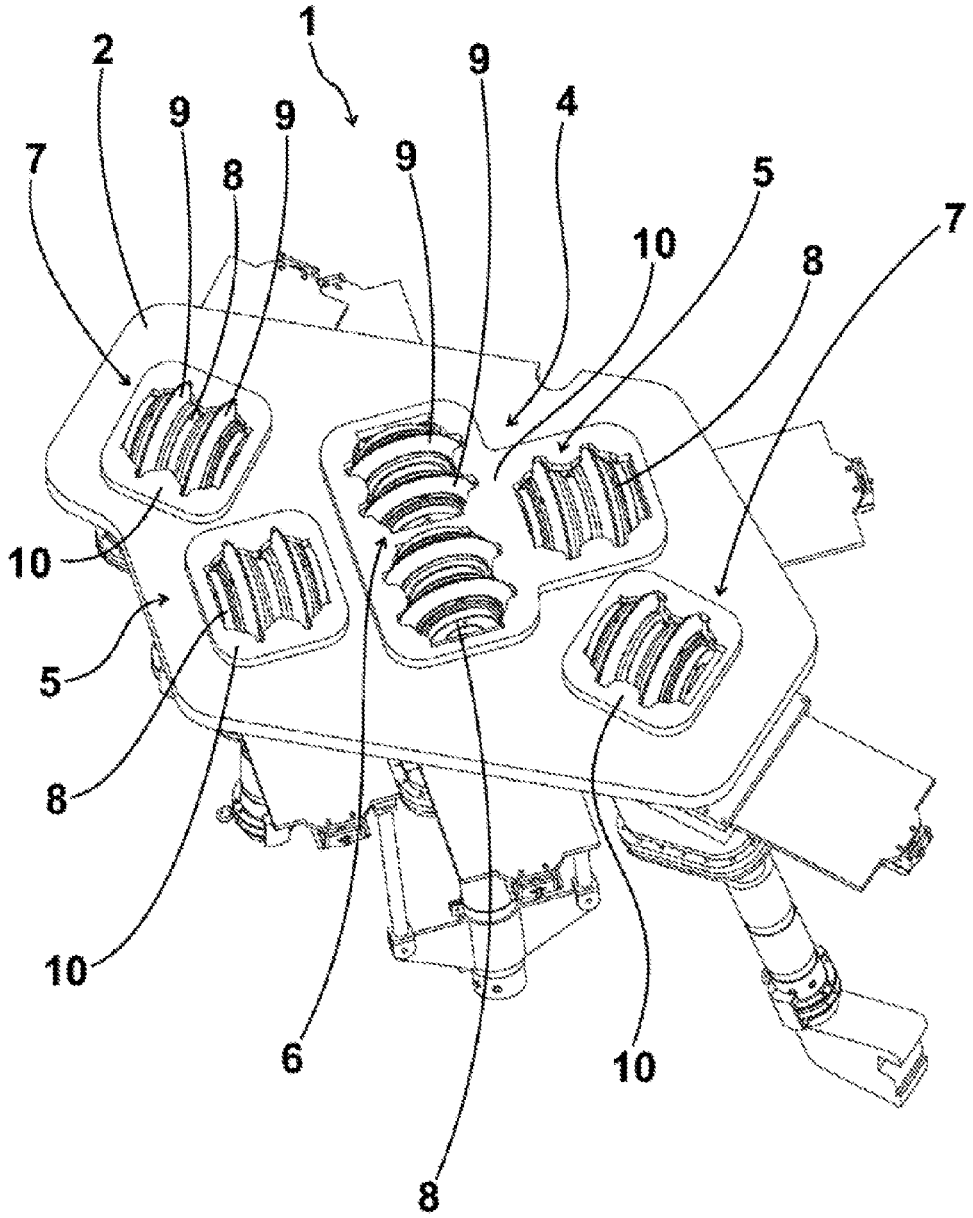
FIG. 2 shows a perspective view of the arrangement according to FIG. 1 in the central area with a view of the front side, in the excavation direction, of a cutting wheel plate of the cutting wheel.

FIG. 2 shows a perspective view of the arrangement according to FIG. 1 in the central area 4 with a view of the front side, in the excavation direction, of the cutting wheel plate 2 of the cutting wheel 1. In addition, in the central area 4 transition cutting roller arrangements 7 are present on the radially outer side of the central cutting roller arrangements 5, 6, and are designed, at least in part, as exemplary embodiments of roller cutter arrangements according to the invention. It is apparent from the illustration according to FIG. 2 that the central cutting roller arrangements 5, 6 and the transition cutting roller arrangements 7 have double cutting rollers 8 as cutting rollers, each of which has two cutting disks 9. The central cutting roller arrangements 5, 6 and the transition cutting roller arrangements 7 are respectively surrounded by a contour-adapted wear protection plates 10, which for protection are mounted on the front side, in the excavation direction, of the cutting wheel plate 2.

Figure 3:
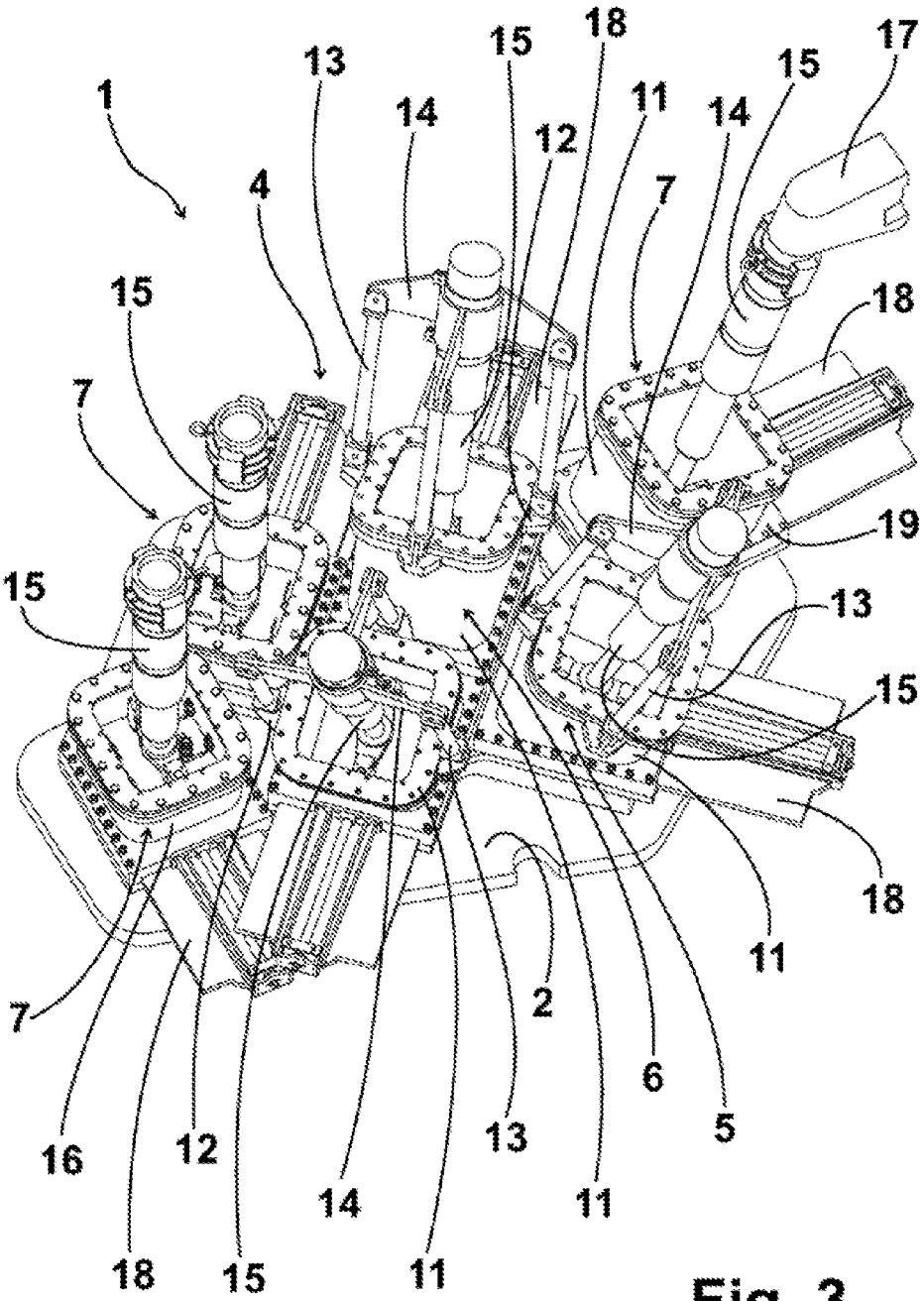
FIG. 3 shows a perspective view of the arrangement according to FIG. 2 in the central area with a view of the rear side, in the excavation direction, of the cutting wheel plate of the cutting wheel.

FIG. 3 shows a perspective view of the arrangement according to FIG. 2 in the central area 4 with a view of the rear side, in the excavation direction, of the cutting wheel plate 2 of the cutting wheel 1. It is apparent from the illustration according to FIG. 3 that the central cutting roller arrangements 5, 6 and exemplary embodiments according to the invention of transition cutting roller arrangements 7 each have an angled interchangeable cup 11 as an interchangeable cup, which is oriented at an angle with respect to the plane of the cutting wheel plate 2, and which, preferably except for rounded corner areas, has a rectangular or square cross section for preferably optimal utilization of the available space. A number of rigid cylinder suspension rods 13, which, with their ends facing away from the cutting wheel plate 2, are each connected to a cylinder suspension 14 associated in each case with an angled interchangeable cup 11, are mounted on a number of angled interchangeable cups 11 via radially outwardly protruding fastening tongues 12. Each cylinder suspension 14, which is situated on the side facing away from the associated angled interchangeable cup 11 of the cutting wheel plate 2, in turn bears a retraction cylinder 15 as a displacement unit, which extends from the cylinder suspension 14 in question into the particular angled interchangeable cup 11.

Additional transition cutting roller arrangements 7 each have a parallel interchangeable cup 16 which is oriented at right angles to the plane of the cutting wheel plate 2.

Retraction cylinders 15 as displacement units, which, with their ends facing away from the cutting wheel plate 2, are mounted on cylinder suspension flanges 17, which in turn are connected to the cutting wheel 1, likewise engage with the angled interchangeable cups 11, which are not provided with cylinder suspension rods 13, and with the parallel interchangeable cups 16, which advantageously have different lengths.

The central cutting roller arrangements 5, 6 as well as the transition cutting roller arrangements 7 are equipped with shutoff sliders 18 of slider units. Each shut-off slider 18 is displaceably supported in a slider housing 19 of the displacement unit, which is integrated into the particular angled interchangeable cup 11 or parallel interchangeable cup 16.

Figure 4:
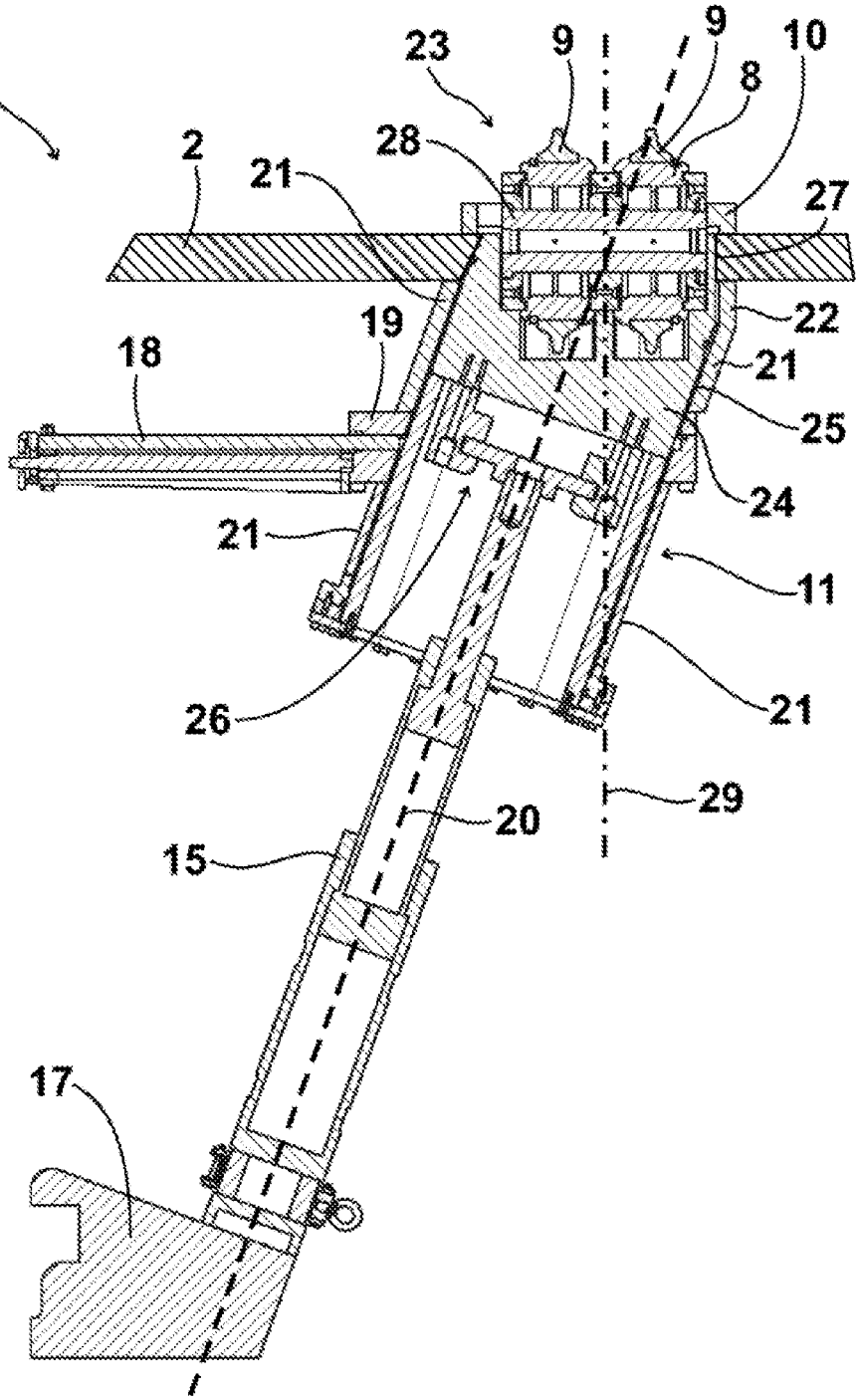
FIG. 4 shows a sectional view of one exemplary embodiment of a roller cutter arrangement according to the invention, with a cutting roller unit in an extended working position.

FIG. 4 shows a sectional view of one exemplary embodiment of a roller cutter arrangement according to the invention in the form of a transition cutting roller arrangement 7. It is apparent from FIG. 4 that the illustrated angled interchangeable cup 11 as well as the other angled interchangeable cups 11 have a two-part design, in each case with a slider housing 19 supported in between. Each angled interchangeable cup 11 has a number of parallel walls 21 oriented in parallel to a displacement axis 20, which is illustrated by a dashed line in FIG. 4 and in the subsequent figures. On the side facing the cutting wheel plate 2 when properly installed, each angled interchangeable cup 11 is designed with an angled wall 22, which is integrally molded onto a parallel wall 21 and angled with respect to the displacement axis 20, but oriented at right angles to the cutting wheel plate 2.

In addition, it is apparent from the illustration according to FIG. 4 that the illustrated transition cutting roller arrangement 7 as an exemplary embodiment of a roller cutter arrangement according to the invention, as well as the central cutting roller arrangements 5, 6 (not illustrated in FIG. 4) as further exemplary embodiments of roller cutter arrangements according to the invention, have a cutting roller unit 23, which, in addition to the double cutting roller 8 already explained in conjunction with FIG. 1, has a solid bearing block 24. The bearing block 24, corresponding to the angled interchangeable cup 11, is designed with a number of parallel walls 25 which are oriented in parallel to the displacement axis 20 and situated in such a way that they are supported on the radially inwardly facing inner sides of the parallel walls 21 of the angled interchangeable cup 11, so as to be displaceable along the displacement axis 20 essentially without play. For displacement of the bearing block 24, the retraction cylinder 15 via a connecting unit 26 engages with the side of the bearing block 24 facing away from the double cutting roller 8.

Situated on the bearing block 24, on the side facing away from the connecting unit 26, is an angled wall 27 which, the same as the angled wall 22 of the angled interchangeable cup 11, is oriented at an angle with respect to the displacement axis 20. On its side facing away from the connecting unit 26, the bearing block 24 bears a bearing axis 28 of the cutting roller unit 23, on which the double cutting roller 8 is mounted. The bearing axis 28 is held at one end on the angled wall 27, and at the other end is held on the parallel wall 25 of the bearing block 24 opposite from the angled wall 27, so that a working axis 29, which is illustrated by a dash-dotted line in FIG. 4 and in the subsequent figures and oriented at right angles to the cutting wheel plate 2, is angled with respect to the displacement axis 20.

In the illustration according to FIG. 4, the cutting roller unit 23 is in an extended working position in which, after the retraction cylinder 15 is extended, the cutting disks 9 protrude beyond the cutting wheel plate 2. In the working position, the bearing block 24, in particular in the area of its angled wall 27 and the parallel wall 25 which adjoins the angled wall 27 of the bearing block 24, rests in a form-fit manner against the corresponding areas of the angled interchangeable cup 11, so that forces acting on the cutting roller unit 23 in the direction of the working axis 29 are partially introduced into the angled interchangeable cup 11 due to the displacement axis 20, which is angled with respect to the working axis 29. As a result, the force to be absorbed by the retraction cylinders 15 is reduced compared to a parallel, flush alignment of the working axis 29 and the displacement axis 20.

Figure 5:
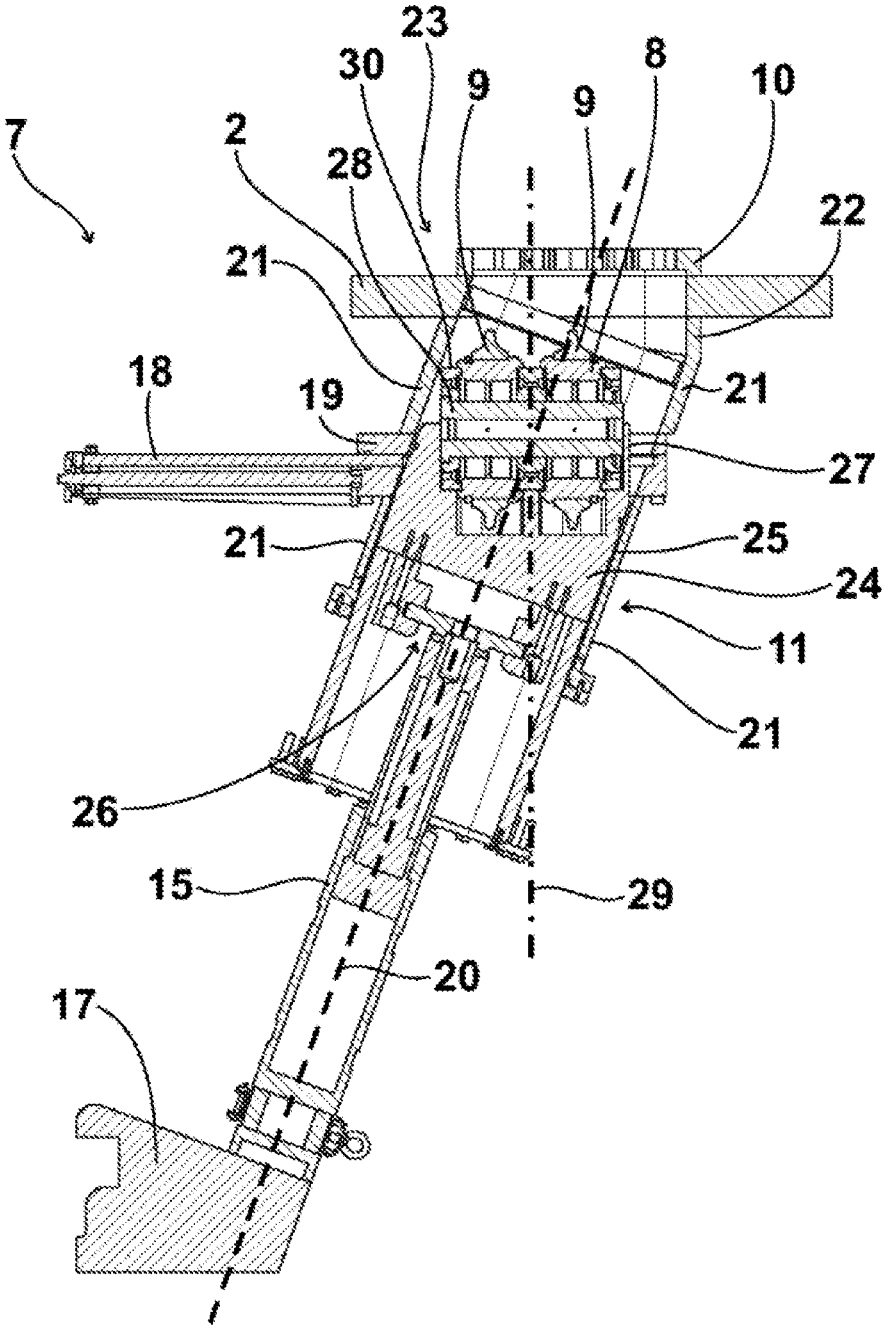
FIG. 5 shows a sectional view of the exemplary embodiment of a roller cutter arrangement according to the invention according to FIG. 4, with the cutting roller unit in an intermediate position.

FIG. 5 shows a sectional view of the exemplary embodiment of a roller cutter arrangement according to the invention in the form of a transition cutting roller arrangement 7 according to FIG. 4, with the cutting roller unit 23 in an intermediate position which, starting from the working position according to FIG. 4, has been assumed by shortening the working length of the retraction cylinder 15. It is apparent from the illustration according to FIG. 5 that a cutting roller outer edge 30 situated opposite from the angled wall 27 of the bearing block 24 is in flush alignment with the parallel wall 25 of the bearing block 24 situated opposite from the angled wall 27 of the bearing block 24, so that the cutting roller unit 23 is displaceable, with engagement along the displacement axis 20, into the angled interchangeable cup 11 without hindrance.

Figure 6:
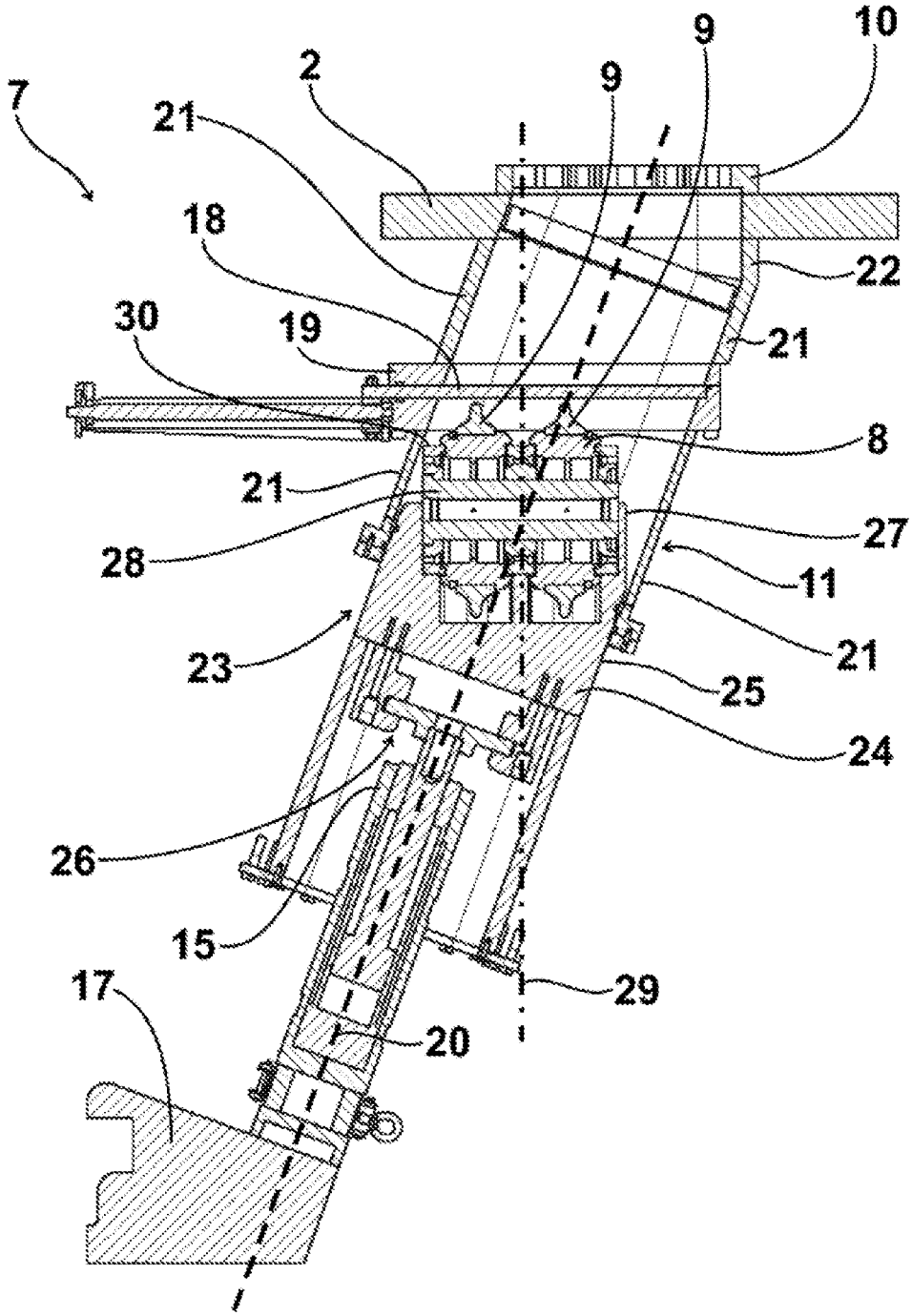
FIG. 6 shows a sectional view of the exemplary embodiment of a roller cutter arrangement according to the invention according to FIG. 4, with the cutting roller unit in a retracted maintenance position.

FIG. 6 shows a sectional view of the exemplary embodiment of a roller cutter arrangement according to the invention in the form of a transition cutting roller arrangement 7 according to FIG. 4, with the cutting roller unit 23 in a retracted maintenance position that has been assumed by maximum shortening of the working length of the retraction cylinder 15. In the maintenance position, the cutting roller unit 23 is retracted far enough into the angled interchangeable cup 11 that the shut-off slider 18, which closes off the angled interchangeable cup 11 in a pressure-tight manner against the front side of the cutting wheel plate 2 in the excavation direction, is insertable into the angled interchangeable cup 11. In the working position according to FIG. 6, the cutting disks 9, which for example have been subjected to relatively high wear, may now be exchanged in the open.

Figure 7:
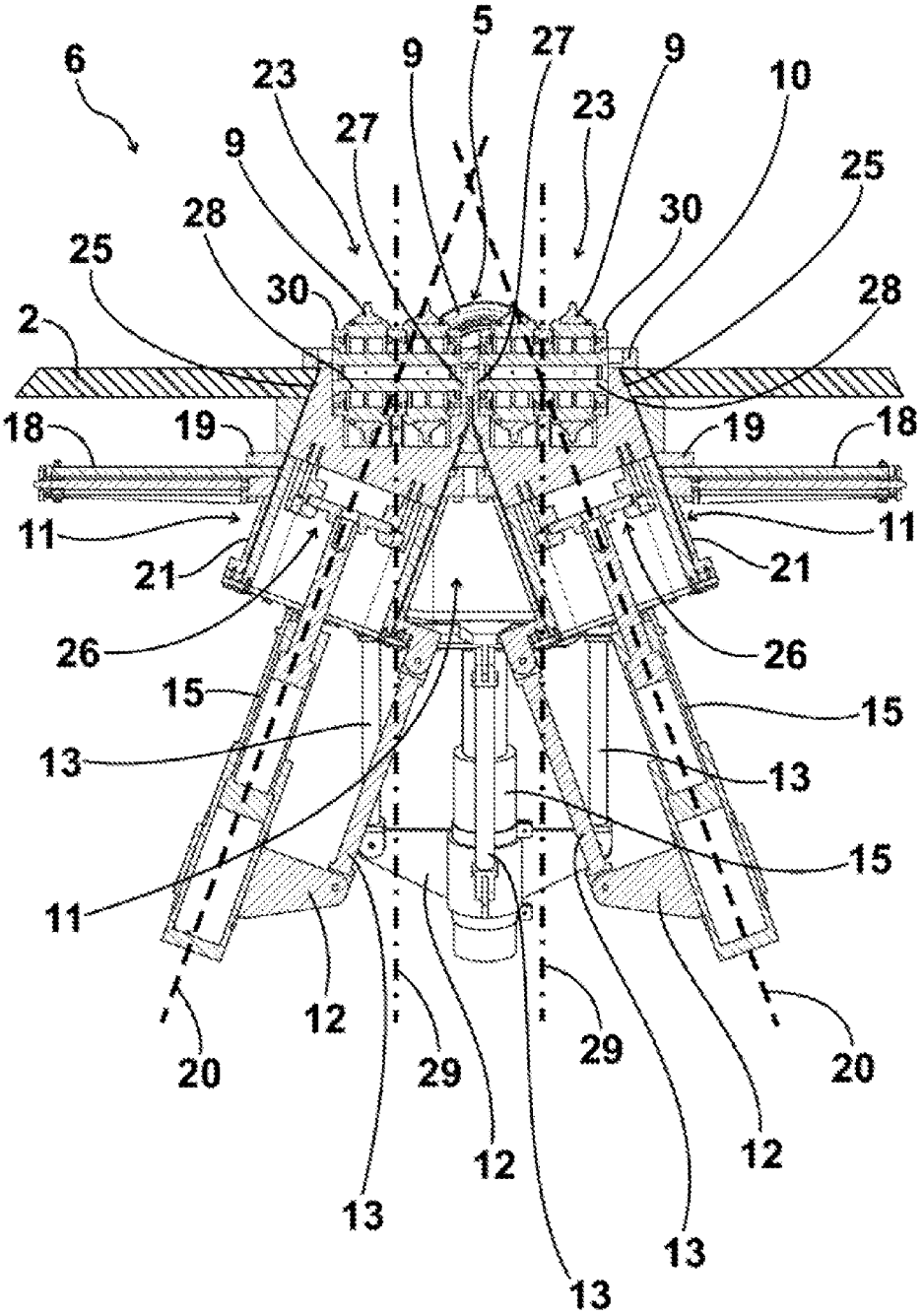
FIG. 7 shows a sectional view of another exemplary embodiment of a roller cutter arrangement according to the invention, with two cutting roller units in an extended working position.

FIG. 7 shows a sectional view of another exemplary embodiment of a roller cutter arrangement according to the invention, which has a doubly fitted central cutting roller arrangement 6 with two cutting roller units 23. The angled interchangeable cups 11 of the central cutting roller arrangement 6 are situated in such a way that the displacement axes 20 converge toward one another in the direction of the cutting wheel plate 2, and intersect at a distance from the cutting wheel plate 2 in the excavation direction.

In the illustration according to FIG. 7, the cutting roller units 23 are in an extended working position, and are closely spaced due to the converging orientation of the two angled interchangeable cups 11 in the direction of the cutting wheel plate 2, and at the same time, at a distance from the cutting wheel plate 2 opposite the excavation direction, due to the inclined angled interchangeable cups 11 of the central cutting roller arrangements 5, 6 and adjacent exemplary embodiments of transition cutting roller arrangements 7 according to the invention, a comparatively large amount of space is present in the central area 4 for situating the retraction cylinders 15 and, in particular, the cylinder suspension rods 13, with a relatively simple design.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A roller cutter arrangement for a cutting wheel of a tunnel boring machine, comprising:

an interchangeable cup;

a bearing block supported in the interchangeable cup and displaceable along a displacement axis;

a cutting roller unit having at least one cutting roller rotatably supported in the bearing block and which acts along a working axis, the working axis angled with respect to the displacement axis; and the interchangeable cup further including parallel cup walls oriented parallel to the displacement axis, and an angled cup wall on a front side of the interchangeable cup which is angled with respect to the displacement axis and oriented parallel to the working axis.

2. The roller cutter arrangement of claim 1, further comprising a plurality of interchangeable cups disposed at an angle with respect to one another.

3. The roller cutter arrangement of claim 2, wherein the bearing block includes parallel bearing block walls oriented parallel to the displacement axis, the bearing block further including an angled bearing block wall which is angled with respect to the displacement axis and oriented parallel to the working axis.

4. The roller cutter arrangement of claim 3, wherein at least one of the cutting rollers disposed opposite from the angled wall of the bearing block includes an outer edge disposed in flush alignment with a parallel wall of the bearing block situated opposite from the angled wall of the bearing block.

5. The roller cutter arrangement of claim 4, further comprising a displacement unit operable to displace the cutting roller unit along the displacement axis between an extended working position and a retracted maintenance position.

6. The roller cutter arrangement of claim 4, further comprising a closure unit operable to close off the interchangeable cup in a pressure-tight manner in a retracted maintenance position of the cutting roller unit.

7. The roller cutter arrangement of claim 3, further comprising a displacement unit operable to displace the cutting roller unit along the displacement axis between an extended working position and a retracted maintenance position.

8. The roller cutter arrangement of claim 3, further comprising a closure unit operable to close off the interchangeable cup in a pressure-tight manner in a retracted maintenance position of the cutting roller unit.

9. The roller cutter arrangement of claim 2, further comprising a displacement unit operable to displace the cutting roller unit along the displacement axis between an extended working position and a retracted maintenance position.

10. The roller cutter arrangement of claim 2, further comprising a closure unit operable to close off the interchangeable cup in a pressure-tight manner in a retracted maintenance position of the cutting roller unit.

11. The roller cutter arrangement of claim 1, wherein the interchangeable cup includes a substantially rectilinear cross section.

12. The roller cutter arrangement of claim 11, further comprising a displacement unit operable to displace the cutting roller unit along the displacement axis between an extended working position and a retracted maintenance position.

13. The roller cutter arrangement of claim 11, further comprising a closure unit operable to close off the interchangeable cup in a pressure-tight manner in a retracted maintenance position of the cutting roller unit.

14. The roller cutter arrangement of claim 1, further comprising a displacement unit operable to displace the cutting roller unit along the displacement axis between an extended working position and a retracted maintenance position.

15. The roller cutter arrangement of claim 1, further comprising a closure unit operable to close off the interchangeable cup in a pressure-tight manner in a retracted maintenance position of the cutting roller unit.

16. A cutting wheel having a plurality of roller cutter arrangements of claim 1, wherein the roller cutter arrangements are disposed in the central area of the cutting wheel.

17. The cutting wheel of claim 16, further comprising a cutting wheel plate, wherein the displacement axes of at least two interchangeable cups converge toward one another in a direction of the cutting wheel plate.

18. The cutting wheel of claim 17, wherein the cutting rollers of the cutting roller units are disposed in the interchangeable cups with displacement axes converging toward one another in the direction of the cutting wheel plate and are disposed in close proximity to one another.

* * * * *